US005799646A

United States Patent [19]

Zia et al.

[11] Patent Number: 5,799,646

[45] Date of Patent: Sep. 1, 1998

[54] CURVED INSHOT BURNER AND METHOD FOR VENT-WITHIN-CASING FURNACE

[75] Inventors: Ninev K. Zia, Indianapolis; William J. Roy, Michigan City; Paul M. Haydock, Zionsville, all of Ind.

[73] Assignee: Carrier Corporation, Syracuse, N.Y.

[21] Appl. No.: 708,845

[22] Filed: Sep. 9, 1996

[51] Int. Cl.[6] ..... F24H 3/08; F23D 14/62

[52] U.S. Cl. ..... 126/110 R; 126/110 AA; 126/116 R; 431/354

[58] Field of Search ..... 126/91 A, 110 R, 126/116 R, 116 A, 110 AA, 85 R, 39 E, 21 A; 431/354, 353

[56] References Cited

U.S. PATENT DOCUMENTS

| | | | |
|---|---|---|---|
| 3,375,081 | 3/1968 | Papp et al. | 126/116 R |
| 3,501,098 | 3/1970 | Evans | 431/354 |
| 3,545,908 | 12/1970 | Lohman | 431/354 |
| 4,108,139 | 8/1978 | Gilliom et al. | 126/21 A |
| 4,418,456 | 12/1983 | Riehl | 431/354 |
| 4,781,170 | 11/1988 | Perl | 126/39 E |
| 4,848,670 | 7/1989 | Pearl, II et al. | 431/354 |
| 5,417,199 | 5/1995 | Jamieson et al. | 126/110 AA |

*Primary Examiner*—Carl D. Price

[57] ABSTRACT

A heating apparatus for delivering heated air to an enclosure comprising a casing with at least two compartments separated by a panel. A burner with an arcuate profile is located within a first compartment of the casing for burning a combustible fuel-air mixture delivered thereto and producing products of combustion. A heat exchanger is located within a second compartment of the casing and has an opposed inlet and outlet. The inlet is in fluid communication with the burner through an aperture in the panel. The heat exchanger receives the products of combustion. A blower is located within the casing for directing a flow of air across the heat exchanger into the enclosure. Through the heat exchanger heat is transferred from the products of combustion to the air. An exhaust system is in fluid communication with the outlet and includes a vent for exhausting the products of combustion from the casing. The vent is contained within the casing.

6 Claims, 3 Drawing Sheets

CURVED INSHOT BURNER AND METHOD FOR VENT-WITHIN-CASING FURNACE

BACKGROUND OF THE INVENTION

1. Field of the Invention

This invention relates generally to a heating apparatus and in particular to a heating apparatus which is convertible for upflow, downflow or lateral flow operation wherein the vent is contained within the housing.

2. Discussion of the Related Art

This invention relates to a multi-poised furnace. The term multi-poised furnace refers to a furnace that can be oriented so that conditioned return air leaving the furnace may be discharged in either an upward or downward direction, as well as horizontally both to the left or to the right, without the need for significant modifications to the furnace.

Furnaces such as those commonly installed to heat homes operate by drawing air from the living quarters through the furnace and returning the warmed air to the living quarters. The air to be heated is typically drawn from the living quarters and delivered to the furnace through a duct system. The air drawn from the living quarters is forced through a heat exchange chamber by a blower. The heat exchanger is heated by combustion product gases which are generated by a burner assembly positioned at the inlet to the heat exchanger. A system of return ducts moves the heated air from the heat exchange chamber and throughout the house. Combustion air is usually provided to the burners by ambient air which may be supplied via inlet ducts or drawn from the outdoors as in a direct vent furnace. Fuel is supplied to the burners via a suitable fuel conduit, e.g. a pipe to conduct natural gas or oil to the burners.

The combustion product gases, after giving up heat to the circulating air through the walls of the heat exchanger, are typically withdrawn from the heat exchanger outlet by a draft inducer blower and flowed via vent ducts for discharge to the atmosphere. It is desirable to position the vent duct within the space defined by the casing of the furnace to reduce the overall size of the installed furnace. With a furnace disposed in the downflow position, the vent duct heretofore could not be disposed within the casing due to the close proximity of the burner assembly.

In order to vent safely in a multi-poise furnace, various methods have been employed. For example, U.S. Pat. No. 5,368,010 discloses the apparatus wherein the furnace cell wall is modified and the length of the burner shortened. Although this method achieves the goal of venting within the casing, modifications of the furnace cell wall cause additional manufacturing costs and may necessitate increased installation procedures. Shortening of the length of the burner can cause difficulties in providing an adequate and efficient combustion mixture in the burner which can result in an overall reduction in the efficiency of the furnace and a reduction in emission quality.

An additional method of safely venting a multi-poise furnace within the casing is disclosed in U.S. Pat. No. 5,417,199. This method involves a configuration wherein the entire vestibule panel, including the blower, the burner assembly and the heat exchanger are turned 180° to accommodate the change from an up-flow to a down-flow position. This method also requires additional installation procedures.

OBJECTS AND SUMMARY OF THE INVENTION

It is therefore an object of the present invention to provide a compact cabinet for a multi-poise furnace.

It is another object of the present invention to provide a multi-poise furnace that vents combustion gases through the casing of the furnace when the furnace is in the downflow position.

It is yet another object of the present invention to provide a multi-poise furnace that vents combustion gases through the casing of the furnace when the furnace is in the downflow position without the need to modify the central cell wall of the furnace.

It is still another object of the present invention to provide a multi-poise furnace that vents combustion gases through the casing of the furnace when the furnace is in the downflow position without the need to shorten the length of the burner.

It is another object of the present invention to provide a multi-poise furnace that vents combustion gases through the casing of the furnace when the furnace is in the downflow position without the need to modify the shape of the heat exchanger.

These and other objects are accomplished by providing a heating apparatus for delivering heated air to an enclosure comprising a casing with at least two compartments separated by a panel. A burner with an arcuate profile is located within a first compartment of the casing for burning a combustible fuel-air mixture delivered thereto and producing products of combustion. A heat exchanger is located within a second compartment of the casing and has an opposed inlet and outlet. The inlet is in fluid communication with the burner through an aperture in the panel. The heat exchanger receives the products of combustion. A blower is located within the casing for directing a flow of air across the heat exchanger into the enclosure. Through the heat exchanger heat is transferred from the products of combustion to the air. An exhaust system is in fluid communication with the outlet and includes a vent for exhausting the products of combustion from the casing. The vent is contained within the casing.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
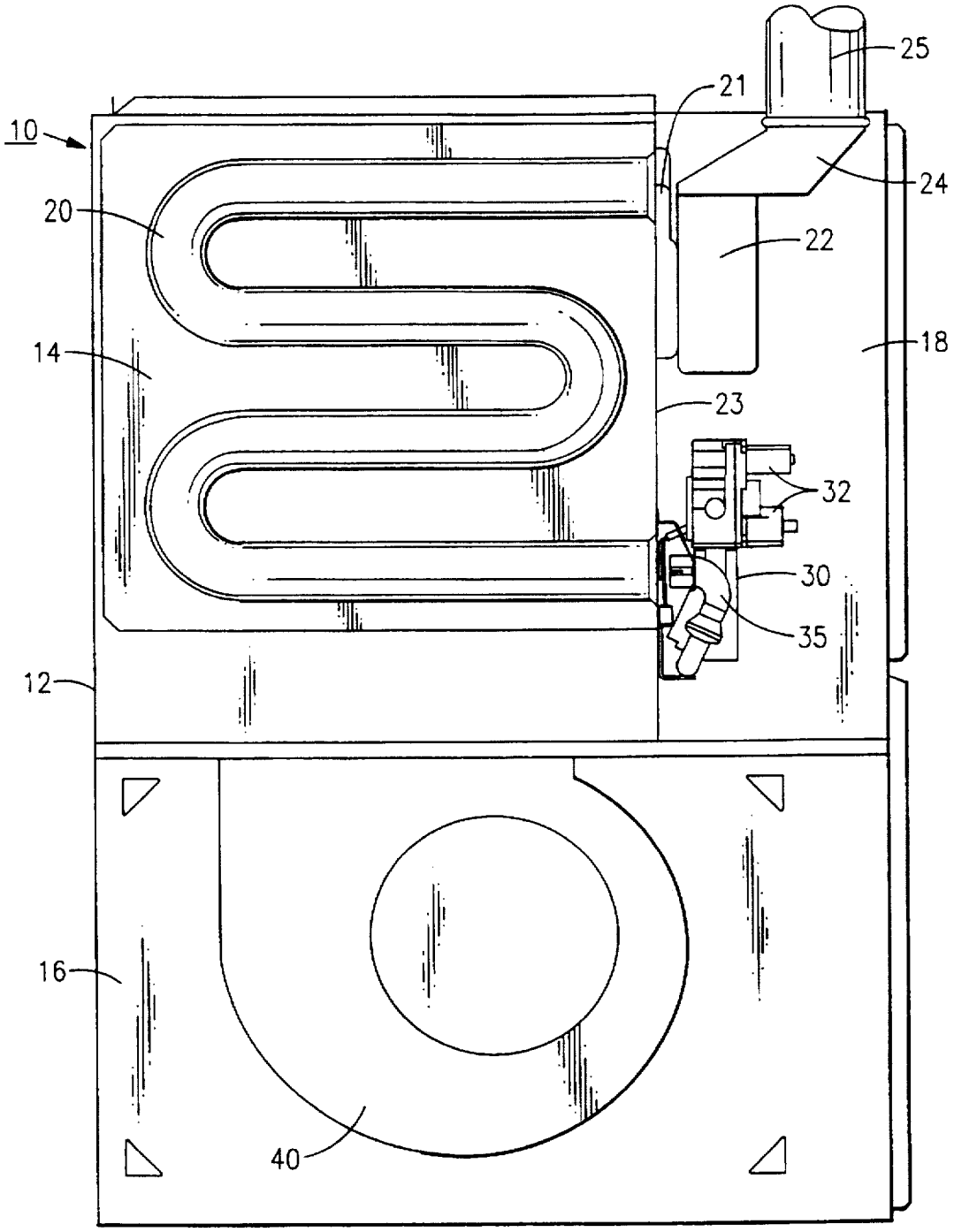
FIG. 1 is a plan view of a multi-poise furnace embodying the present invention with the furnace configured in the up-flow position.

Referring now to FIG. 1, there is shown a multi-poised furnace 10 configured for an up-flow installation. As is known in the art, a multi-poise furnace may be installed in an up-flow, down-flow, or lateral-flow orientation. This capability offers flexibility in installation and decreases the need to produce a number of different furnace designs. The furnace 10 includes an outer casing 12 which encompasses substantially all the components of the furnace 10. The furnace 10 has a plurality of compartments; in the embodiment as shown, the furnace includes a heat exchange compartment 14, a blower compartment 16, and a vestibule compartment 18. It is understood by one skilled in the art that a furnace may include fewer or more compartments depending upon the complexity of the furnace and the need to further compartmentalize more complex instruments.

The heat exchange compartment 14 contains a heat exchanger 20. A heat exchanger is a device used to transfer heat from a fluid or gas flowing on one side of a barrier to a fluid or gas flowing on the other side of the barrier. One skilled in the art would understand that the heat exchange compartment 14 may contain one or more heat exchangers. Fuel is fed to a burner assembly 30 (explained in greater detail below) from an outside source (not shown) and is burned to produce hot combustion gases. The heat exchanger 20 has an inlet side which accepts the combustion gases from the burner assembly 30. The hot combustion gases are drawn through the heat exchanger 20 by an inducer 22 which is located at the outlet side of the heat exchanger 20. In furnaces containing more than one heat exchanger, the outlet side of the heat exchangers connect to a coupling box 21 which gathers the flow from the multiple heat exchangers into the inducer 22.

The room air that is to be heated is drawn to the furnace 10 through a duct system (not shown). The room air is forced over the heat exchangers 20 by a blower 40. The room air passes over the heat exchangers 20 and picks up heat from the heat exchangers 20. The heated room air is returned to the living quarters by another duct system (not shown).

Figures 2, 4:
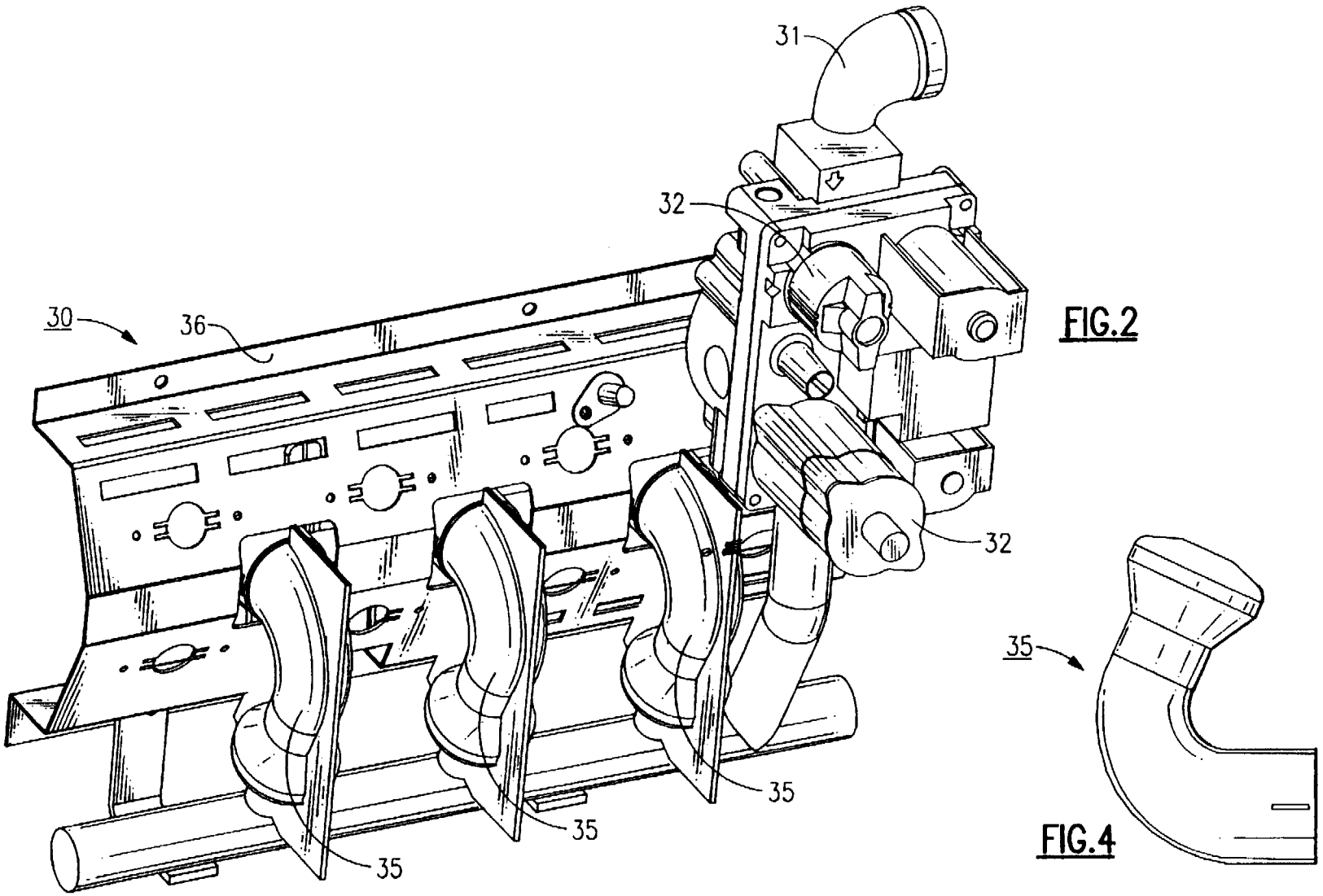
FIG. 2 is a plan view of a burner assembly embodying the present invention.
FIG. 4 is a side view of a burner of a furnace of the present invention.

Referring now to FIG. 2, there is shown the burner assembly 30. The burner assembly receives fuel into the inlet port 31. The fuel is then passed through a valve or series of valves 32—32 which, inter alia, serve to control the pressure of the fuel as it passes through the burner assembly 30. One skilled in the art would be familiar with different valve configurations used in an attempt to achieve optimum fuel burning efficiency. The particular valve assembly chosen is not part of the present invention.

The fuel is delivered to curved inshot burners 35 via a manifold system 34. It is known in the art in gas-fired appliances to utilize curved ribbon burners, wherein the flame depends from the burner tube laterally along the length of its axis, and curved disc burners, wherein the flame depends radially from one central point. Heretofore, a curved inshot burner, wherein the flame depends from the burner on the longitudinal axis, has not been known in the art. Inshot burners to date have received fuel from the manifold and delivered combustion gases to the heat exchangers in a 180° alignment. The curved inshot burner of the present invention is a burner that is not in a 180° alignment. The profile of the burner is generally arcuate in shape. Of course, this arcuate shape can be obtained by a gradual curvature as shown in the drawings or by connecting short straight pieces to effectively form an arcuate profile. Although the exact parameters of the curved inshot burner will vary from furnace model to furnace model, we have found that, as shown in FIG. 4, a burner 35 with a 1.16 cm diameter, an arcuate curve of the longitudinal axis of the burner of 65 degrees, and a radius of curvature of the longitudinal. As will be seen in FIG. 4, burner member 35 comprises at its one end, a converging portion, connected to a uniform diameter portion, which in turn is connected to an expanding diameter portion, wherein the expanding diameter position expands from its smaller diameter at its one end to an expanded diameter at its other end. It is this expanding diameter portion which is arcuate in form.

The curved inshot burners 35 ignite the fuel and deliver the combustion gases to the heat exchanger 20 (FIG. 1). The burner assembly 30 is positioned along the cell wall 23 by a mounting plate 36. The mounting plate secures the burner assembly 30 to the cell wall 23 and properly aligns the curved inshot burners 35—35 in a position to most efficiently deliver the combustion product gases to the heat exchanger 20.

The combustion product gases pass through the heat exchangers 20 and give up heat to the room air that is blown over the heat exchangers 20. The combustion product gases exit the heat exchanger via the draft inducer 22. The gases travel into the vent collar 24 and then exit to the outside via a vent 25. The furnace shown in FIG. 1 is in the upflow configuration wherein the exit from the draft inducer 22 is in relatively close proximity to the vent 25 such that the vent 25 need not pass through a substantial length of the casing 12.

Figure 3:
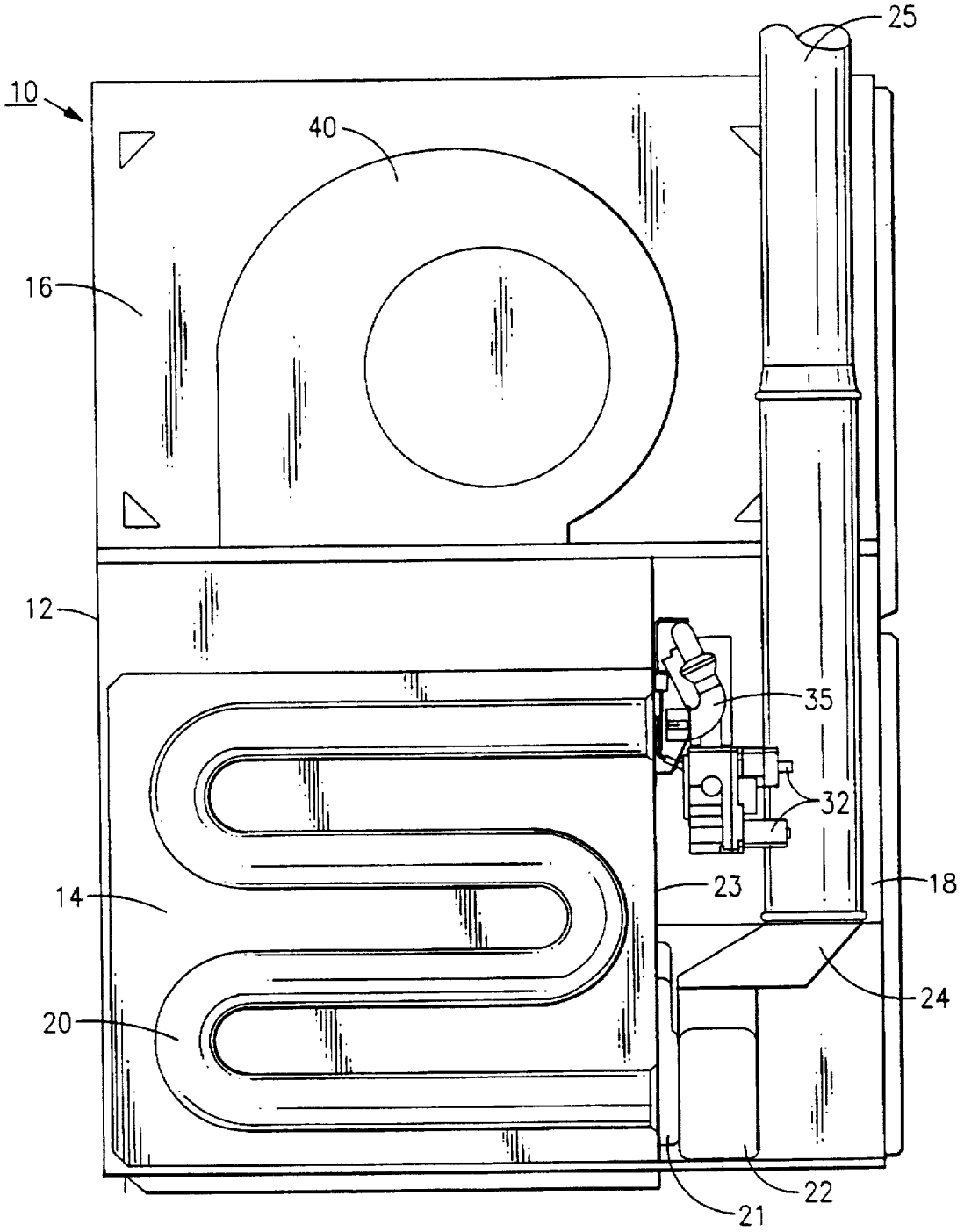
FIG. 3 is a plan view of the multi-poise furnace embodying the present invention with the furnace configured in the down-flow position.

Referring now to FIG. 3, the furnace 10 is now shown in the downflow configuration. The furnace 10, while in the downflow configuration, operates in the same manner as when configured in the upflow configuration. When the furnace 10 is in the downflow configuration, the vent 25 must pass through a more substantial length of the casing 12.

Heretofore, the vent in furnaces passed in close proximity to the burners which necessitated modifications of the cell wall to recess the burners, an increase in the overall size of the furnace, or a shortening of the length of the burners in order to accommodate the vent. In the present invention, because the burners 35 are curved, the vent 25 can pass in close proximity to the curved inshot burners 35 without the need to modify the cell wall 23, increase the overall size of the furnace 10, or shorten the effective length of the burners 35—35. The vent 25 passes the combustion gases through the vestibule chamber 18, then passes the combustion gases through the blower chamber 16, and finally passes the combustion gases to the outside.

While this invention has been explained with reference to the structure disclosed herein, it is not confined to the details as set forth and this application is intended to cover any modifications and changes as may come within the scope of the following claims.

What is claimed is:

1. A heating apparatus for delivering heated air to an enclosure, said heating apparatus comprising:

a casing with at least two compartments separated by a panel;

an inshot burner located within a first compartment of said casing for burning a combustible fuel-air mixture delivered thereto, said inshot burner having an arcuate profile and producing products of combustion flowing axially therefrom;

a heat exchanger located within a second compartment of said casing and having an opposed inlet and outlet, said inlet being in fluid communication with said inshot burner through an aperture in said panel, said heat exchanger receiving said products of combustion;

a blower located within said casing for directing a flow of air across said heat exchanger into the enclosure, whereby heat is transferred from said products of combustion to said air; and, exhaust means in fluid communication with said outlet, said exhaust means including a vent for exhausting the products of combustion from said casing, said vent contained within said casing;

whereby, a clear space is provided for said vent to be located between said burner and a wall of the casing.

2. The heating apparatus of claim 1 wherein said heating apparatus is disposed in a down-flow orientation.

3. A heating apparatus as set forth in claim 1 wherein said inshot burner includes an expanding diameter portion and further wherein said arcuate profile is in said expanding diameter portion.

4. A multi-poised furnace comprising:

a casing with at least two compartments separated by a panel;

an inshot burner located within a first compartment of said casing for burning a combustible fuel-air mixture delivered thereto, said inshot burner having an arcuate profile and producing products of combustion flowing axially therefrom;

a heat exchanger located within a second compartment of said casing and having an opposed inlet and outlet, said inlet being in fluid communication with said inshot burner through an aperture in said panel, said heat exchanger receiving said products of combustion;

a blower located within said casing for directing a flow of air across said heat exchanger into said enclosure, whereby heat is transferred from said products of combustion to said air; and, exhaust means in fluid communication with said outlet, said exhaust means including a vent for exhausting the products of combustion from said casing, said vent contained within said casing;

whereby, a clear space is provided for said vent to be located between said burner and a wall of the casing.

5. The multi-poised furnace of claim 4 wherein said heating apparatus is disposed in a downflow orientation.

6. A multi-poised furnace as set forth in claim 4 wherein said inshot burner includes an expanding diameter portion and further wherein said arcuate profile is in said expanding diameter portion.

* * * * *